US006486405B2

(12) United States Patent
Lin

(10) Patent No.: US 6,486,405 B2
(45) Date of Patent: Nov. 26, 2002

(54) ARRANGEMENT OF DIFFERENTIAL PAIR FOR ELIMINATING CROSSTALK IN HIGH SPEED APPLICATION

(75) Inventor: Yu Hsu Lin, Fremont, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/728,849

(22) Filed: Dec. 1, 2000

(65) Prior Publication Data

US 2002/0066589 A1 Jun. 6, 2002

(51) Int. Cl.[7] ..... H01B 11/00
(52) U.S. Cl. ..... 174/113 R; 174/27
(58) Field of Search ..... 174/27, 36, 113 R, 174/32

(56) References Cited

U.S. PATENT DOCUMENTS

| | | | | |
|---|---|---|---|---|
| 1,924,840 A | * | 8/1933 | Droste et al. | 174/36 |
| 2,086,629 A | * | 7/1937 | Mead | 174/27 X |
| 6,215,062 B1 | * | 4/2001 | Kimber | 174/27 |
| 6,218,621 B1 | * | 4/2001 | Kuczynski | 174/113 R |

* cited by examiner

*Primary Examiner*—Chau N. Nguyen
(74) *Attorney, Agent, or Firm*—WeiTe Chung

(57) ABSTRACT

A differential pair arrangement includes two mutually intersecting differential pairs of conductors wherein each pair may perform as both aggressor and victim. The crosstalk imposed on the victim conductor by the pair of aggressor differential pair is substantially zero at any moment and any section. Therefore, there is no crosstalk accumulated along the longitudinal direction of the conductors, and thus the far-end or the near-end crosstalk is substantially zero.

1 Claim, 4 Drawing Sheets

ARRANGEMENT OF DIFFERENTIAL PAIR FOR ELIMINATING CROSSTALK IN HIGH SPEED APPLICATION

BACKGROUND OF THE INVENTION

1. Field of the Invention

The invention relates to electrical conductor arrangements for high speed transmission, and particularly to the arrangements for use with differential pair(s) to eliminate the crosstalk thereof.

2. The Related Art

Crosstalk is the concern in high speed transmission. In fact, the concept of "differential pair" of the conductors to eliminate the crosstalk between the adjacent conductors are popularly used in the industry field. Understandably, the basic theory of the differential pair arrangement is based on the crosstalk impact from the same "aggressor" source to the respective "victim" conductors of the differential pair being the same with each other when the two (victim) conductors of the victim differential pair are respectively equally spaced from the same "aggressor" source. Under this situation, the undesired crosstalk noise signal due to the same "aggressor" source may be theoretically eliminated with the subtraction calculation. This phenomena is generally based on the assumption that the victim differential pair is spaced from the aggressor source with a significant distance while the internal distance between the two conductors of the victim differential conductors internally is relatively small. Understandably, regardless of the circuits on the printed circuit board, the contacts in the connector, or the wires of a cable, the distance between the differential pair of victim conductors and the aggressor source is relatively small, so that the induced crosstalk from the same aggressor source to the two respective conductors of the victim differential pair will be obviously different. This is an inherent shortcoming.

For example, U.S. Pat. Nos. 5,647,770, 5,971,813, 6,017,247 and 6,120,329 disclose some approaches to eliminate the crosstalk among the differential pairs of conductors. Obviously, the way these approaches used is generally to intentionally oddly deflect/off some portions of the corresponding contacts of the modular jacks to be coupled/close to other corresponding contacts so that the crosstalk measured at the ends of the contact tails, via which the modular jacks are mounted on the mother board, may be reduced. Understandably, such a method requires complicated calculation and/or plural try-and-errors. Additionally, such complicated/odd configurations of the corresponding contacts make it difficult to manufacture/assemble the modular jack. Moreover, due to such offset/deflection arrangement of some contacts, the lengths of the electrical paths of the respectively contacts will be different, thus resulting in the skew effect which is also not desired by the electrical circuit design.

U.S. Pat. Nos. 3,761,842 and 6,057,512, and the copending application Ser. No. 09/535,426 filed on Mar. 27, 2000 with the same assignee, disclose the similar approach in another application, i.e., the cable field, where the differential pair of wires are twisted for eliminating the crosstalk from the adjacent wires. Understandably, the twisted arrangement of the differential pairs makes it difficult to manufacture the whole cable, increases the lengths of the electrical paths, i.e., increasing the resistance thereof, and also results in the improper skew effect.

Yet, the similar approach in another field can be referred to FIG. 1 disclosing the differential pairs of conductors/ traces are applied on the printed circuit board, wherein a ground circuit is disposed between every two adjacent differential pairs of signal conductors for eliminating the crosstalk therebetween. Understandably, the placement of plural ground circuits between every adjacent two different pairs of signal conductors will occupy significant space on the printed circuit board, thus opposing the miniaturization trend of the electrical industry.

Anyhow, disregarding the foregoing disadvantages of the existing approaches used in the different fields, other than the crosstalk concern another important issue for the high speed transmission is impedance matching/consistency requirement wherein the impedance corresponds to the associated inductance and capacitance thereof. The inconsistency/un-matching of the impedance along the electrical path may create the reflection of the signal and thus jeopardize the quality of the signals which is looking for the required so-called eye pattern of the signal configuration, i.e., the signal configuration being not fallen within the minimum region of such an eye-pattern for assuring transmission stability and reliability thereof. Understandably, the odd deflection used in the modular jack contacts and the twisted pair of the wires may result in impedance inconsistence along the electrical path because of changeable/inconsistent distance between the differential pair of victim conductors and the corresponding aggressor source. Therefore, the quality of the signals can not meet the preferable eye pattern. Additionally, in the differential pair application, the two conductors of each victim differential pair ideally should be arranged as close as possible so as to try to achieve the close/similar magnitude of the induce crosstalk noise for elimination by subtraction. While the internal distance between two conductors of each differential pair is also an important factor for controlling the impedance thereof. Moving closer to each other may result in the un-matching or incompatible impedance along the transmission path. In other words, most of time there is a conflict situation between the reduction of the crosstalk and the consistency of the impedance because of the inherent structure limitations and electrical characters. In other words, it is required to scarify some portions of at least one of these two factors for implementation.

Moreover, in all the aforementioned three type application fields, the crosstalk can not efficiently or ideally eliminated, and thus for the far-end crosstalk, the peak value of each individual victim conductor may not be in phase due to the propagation delay skew. In other words, because of the possible propagation delay skew, the induced crosstalk of each differential pair can not be symmetrically eliminated with each other. Under this situation, the actual differential far-end crosstalk may be higher than the difference of the peak value.

Therefore, an object of the invention is to provide a differential pair arrangement of the conductors where the plain, systematic and scientific arrangement is presented under a controllable and predictable sense.

Another object of the invention is to provide an arrangement where the crosstalk can be efficiently eliminated or even disappear at each single moment so that the crosstalk of either the far-end or the near-end is expectedly desirable zero.

Yet another object of the invention is to provide an arrangement where the crosstalk can be zeroed down while without jeopardizing the compatibility of impedance thereof.

SUMMARY OF THE INVENTION

According to an aspect of the invention, an arrangement of differential pairs of conductors includes two pairs of conductors intersect with each other at a right angle to form a cross-like configuration thereof wherein the distance between the respective victim conductor and one of the adjacent differential pair of aggressor conductors is equal to that between the same respective victim conductor and the other of the adjacent differential pair of aggressor conductors so that the crosstalk imposed on such a respective victim conductor due to the adjacent differential pair of conductors can be almost zeroed down at every moment, thus assuring no crosstalk at either far-end or near-end of such a victim conductor.

Another feature of the invention is that the respective victim conductor can be a single-ended type rather than a differential pair type wherein such a victim conductor may be moveably disposed at any position which is located in a plane equidistant with the differential pair of aggressor conductors.

Another feature of the invention is to almost zero down the crosstalk along the whole length of the victim conductor whereby the impedance thereof can be adjusted to meet the impedance of the next connecting part around the two ends of the victim conductor without jeopardizing the crosstalk thereof.

DETAILED DESCRIPTION OF THE PREFERRED EMBODIMENTS

References will now be in detail to the preferred embodiments of the invention. While the present invention has been described in with reference to the specific embodiments, the description is illustrative of the invention and is not to be construed as limiting the invention. Various modifications to the present invention can be made to the preferred embodiments by those skilled in the art without departing from the true spirit and scope of the invention as defined by appended claims.

Figure 1:
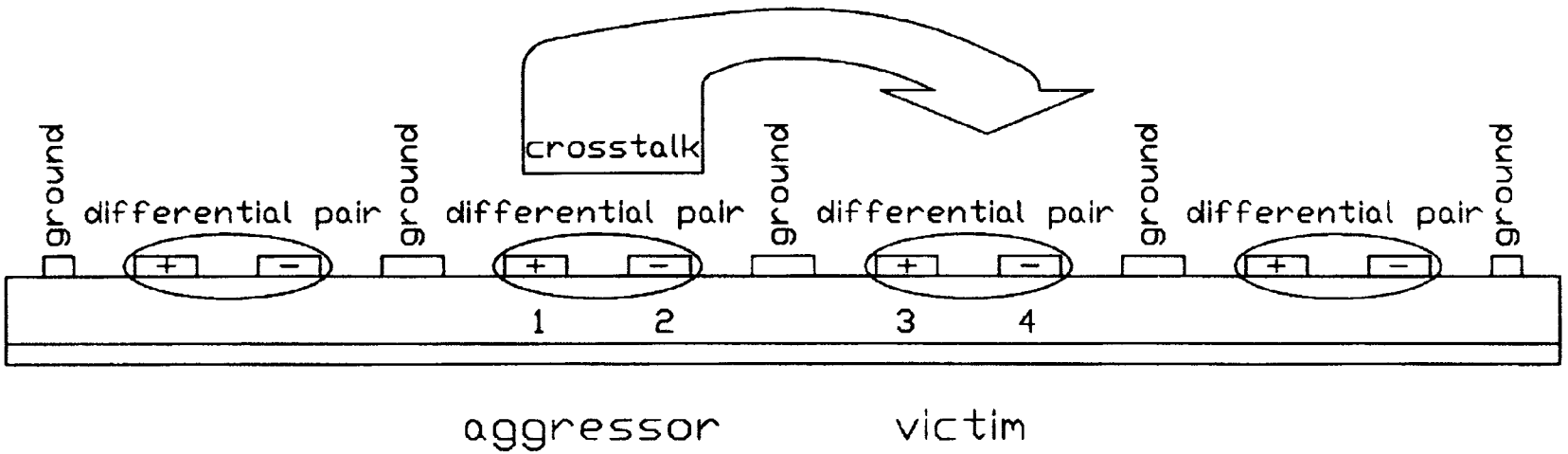
FIG. 1 (PRIOR ART)
FIG. 1 is a diagram showing the ground circuit with the associated differential pair of conductive circuits on a printed circuit board of the prior art.
Figure 2:
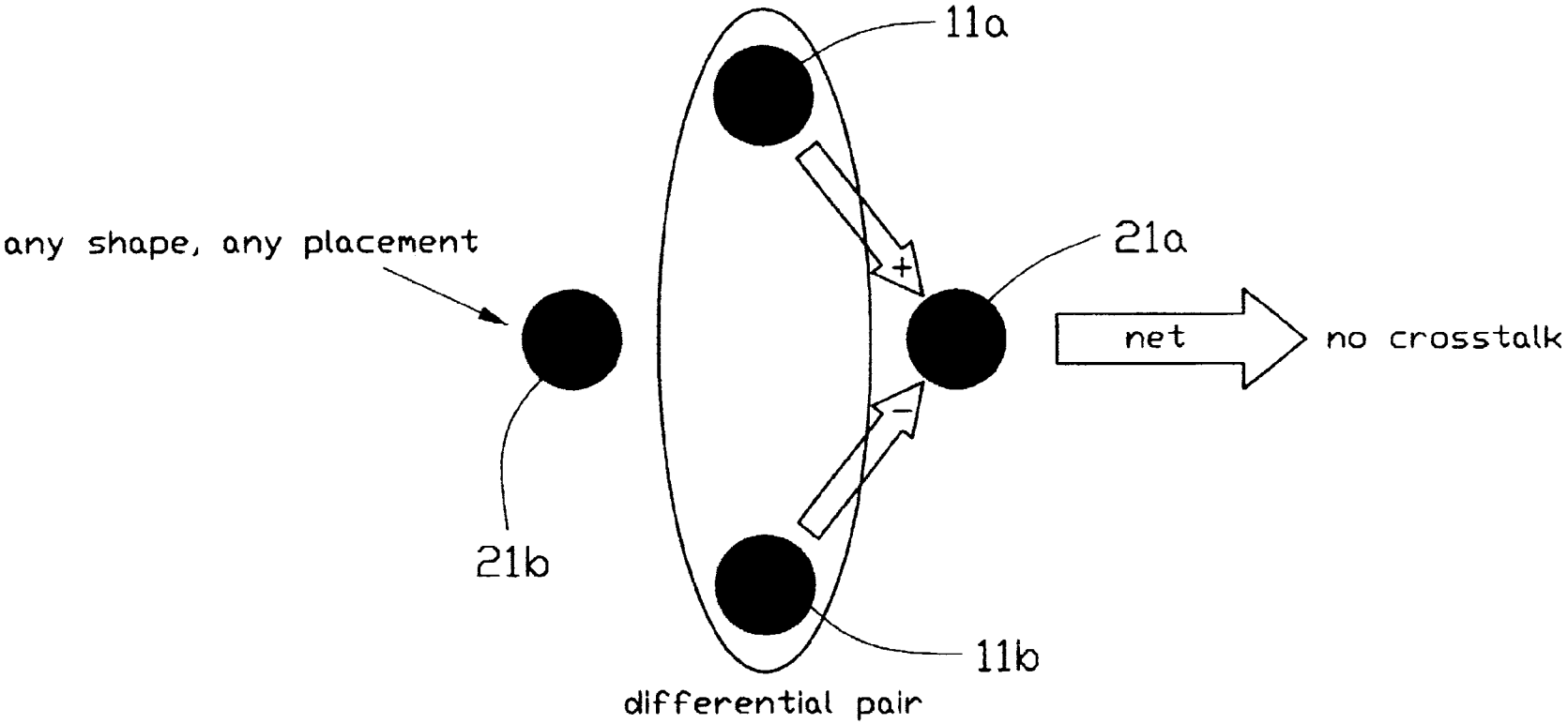
FIG. 2 is a cross-sectional view of a presently preferable embodiment of an arrangement of two normally mutually intersecting differential pairs of conductors of a cable according to the invention.

It will be noted here that for a better understanding, most of like components are designated by like reference numerals throughout the various figures in the embodiments. Attention is directed to FIG. 2 wherein a first differential pair of conductors 11*a*, 11*b* and a second differential pair of conductors 21*a*, 21*b* are arranged in a mutually normal intersection or a diamond-like configuration. Understandably, the first and second differential pairs are mutually treated as "aggressor" and "victim" pairs. Anyhow, regardless of which role each pair plays, the crosstalk to each differential pair is substantially zero.

Fox example, under the condition of deeming the first differential pair of conductors 11*b*, 11*b* the aggressor ones and the second differential pair of conductors 21*a*, 21*b* the victim ones, because the distance between the victim conductor 21*a* and the aggressor conductor 11*a* is equal to that between the same victim conductor 21*a* and another aggressor conductor 11*b* wherein the aggressor conductor 11*a* is in a plus/positive phase while the aggressor conductor 11*b* is in a minus/negative phase having the same magnitude with the aggressor conductor 11*a*, the victim conductor 21*a* will receive the same magnitude crosstalk from the aggressor conductors 11*a*, 11*b* while in an opposite orientation. Because the crosstalks to the victim conductor 21*a* from the respective aggressor conductors 11*a*, 11*b* counterbalance each other, the total crosstalk imposed on the victim conductor 21*a* will be zero.

In the same principle, the crosstalk to the victim conductor 21*b* by the aggressor differential pair is also be zero. Similarly, by treating the different pair of conductors 21*a*, 21*b* the aggressor ones and the differential pair of conductors 11*a*, 11*b* the victim ones, the victim conductor 11*a* has zero crosstalk due to symmetry arrangement of the aggressor conductors 21*a*, 21*b* therewith, and the victim conductor 11*b* also has the same result.

Therefore, the differential pairs 11*a*, 11*b*, 21*a* and 21*b* will not create any crosstalk along the longitudinal direction of the whole length thereof. For example, the arrangement of the two differential pairs may be applied to the cable assembly where 11*a*, 11*b*, 21*a* and 22*b* respectively represent two differential pairs of wires each with the conductor therein and extending along the longitudinal direction penetrating the drawing sheet of FIG. 2.

It can be understood that to the victim conductor, the crosstalk at each moment is zero, and thus the final crosstalk at the far end is also zero even under an accumulation calculation along the longitudinal direction of the conductor. In this embodiment, these two differential pairs can be assembled as one basic unit which may cooperate with other conductors in a variation for application.

Figure 3:
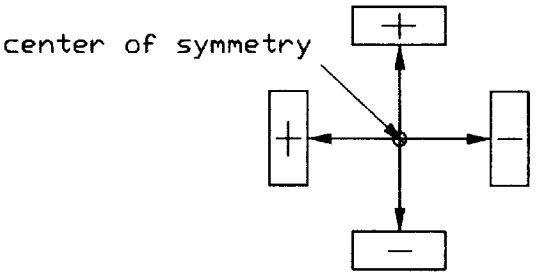
FIG. 3 is a diagram illustrating the second embodiment having the two differential pairs of conductors arranged in an all-direction symmetrical manner according to the invention.

FIG. 3 is a diagram showing the geometry of the second embodiment where the conductors of the two coupled differential pairs may be deemed as the circuit traces or the like. Different from the first embodiment having the circle cross-section of each conductor, the conductors in FIG. 3 define a wider side to face the symmetry center (which is not geometrical but is functional). While similar to the first embodiment, the distance between the symmetry center to each conductor is same as one another.

Figure 4:
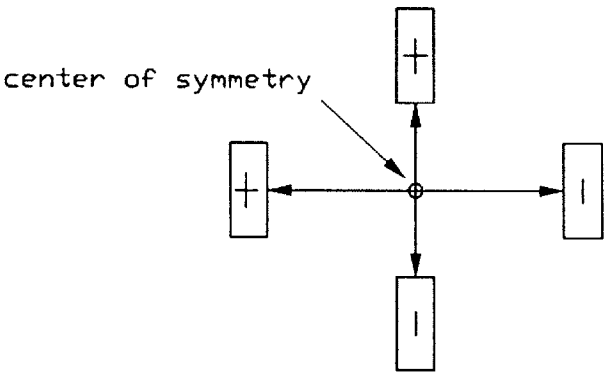
FIG. 4 is a diagram illustrating the third embodiment having the two differential pairs of conductors arranged in a two-coordinate symmetrical manner according to the invention.

FIG. 4 shows the geometry of the third embodiment similar to the second embodiment while with different orientation of these two differential pairs wherein the transverse differential pair facing the symmetry center with the shorter side are disposed closer to the symmetry center than the other differential pair for impedance consideration which changes with inverse proportion of the corresponding distance. Understandably, in the first embodiment if the first differential pair of conductors 11*a*, 11*b* have the smaller cross-sectional size than the second differential pair, the distance to the symmetry center thereof may be shorter than that of the second differential pair for the same consideration. Anyhow, it is noted that in the third embodiment because these two differential pairs are mutually symmetrical with regard to the symmetry center, the crosstalk effect to each conductor is still the same zero as what shown in the first and the second embodiment regardless of whether the distance of the transverse conductors to the symmetry center has been shortened or not.

Figure 5:
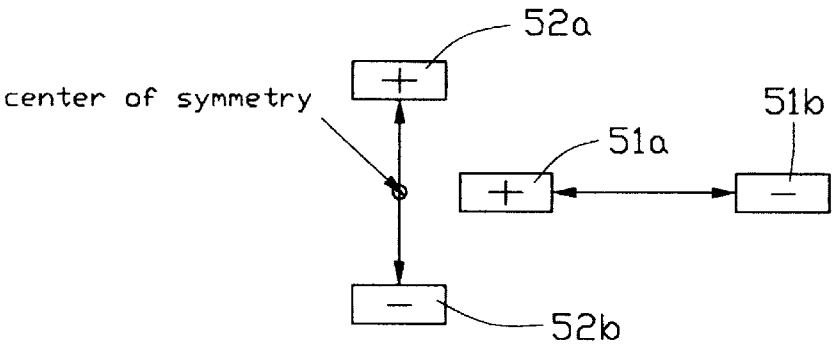
FIG. 5 is a diagram illustrating the fourth embodiment having the two differential pairs of conductors arranged in a one-coordinate symmetrical manner according to the invention.

FIG. 5 shows each of the victim differential pair 51*a*, 51*b* may be moveably disposed at any position along a center vertical line, i.e., the vertical equal separation line, between the aggressor differential pair 52*a*, 52*b*. Understandably, under this situation, these two pairs are no longer mutually zeroed down for their crosstalk. In opposite, in FIG. 5 only the differential pair 51*a*, 51*b* owns the zero crosstalk while the differential pair 52*a*, 52*b* not.

Figure 6:
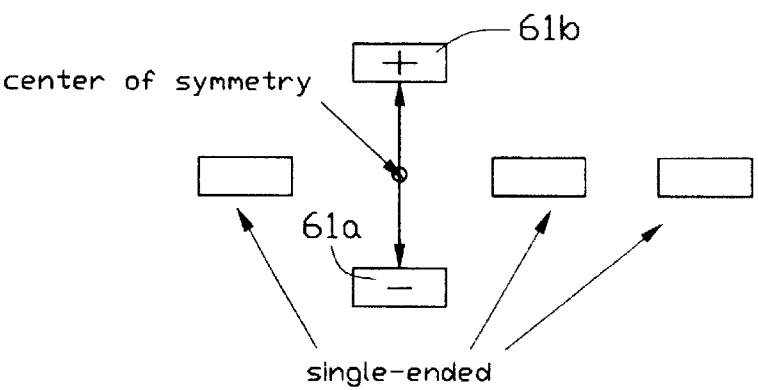
FIG. 6 is a diagram illustrating the fifth embodiment having one differential pair of conductors and a plurality of single-ended conductor arranged in a one-coordinate symmetrical manner according to the invention.

Similarly, FIG. 6 shows a plurality of single-ended conductors disposed along the center vertical line of the aggressor differential pair 61*a*, 61*b* wherein the crosstalk of each individual single-ended conductor will be zero.

Figure 7:
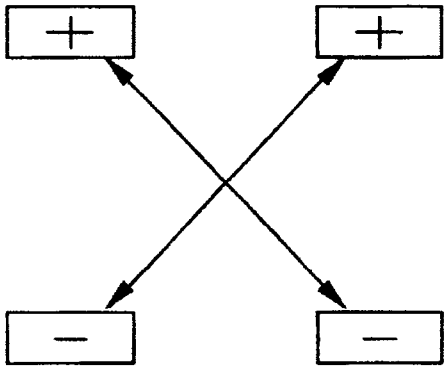
FIG. 7 is a diagram illustrating the sixth embodiment having two pairs differential pairs of conductors in a deformed manner according to the invention.

FIG. 7 shows a variation of the embodiment shown in FIG. 4. It is understood that aforementioned embodiments may be applied to the conductive traces printed on the printed circuit board. In FIG. 4, it requires three layers in the vertical direction to arrange these two differential pairs. Alternately, in FIG. 7 the variation of the two differential pairs may be applied with two layers in the vertical direction.

Figure 8:
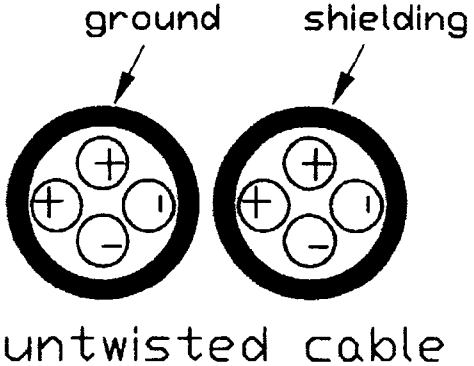
FIG. 8 is diagram illustrating the seventh embodiment for use within the cable application where every two normally mutually intersecting differential pairs is circumferentially shielded to prevent the crosstalk thereof.

FIG. 8 shows the application of the first embodiment where every two mutually vertically intersected differential pairs are shielded for not interfering with another adjacent set. Under this situation, the whole crosstalk of the all cable can ideally be zero.

Figure 9:
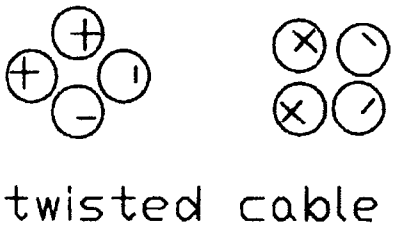
FIG. 9 is a diagram illustrating the eighth embodiment for use within the cable application where the wires of the cable are twisted along their longitudinal direction.

FIG. 9 shows another application of the first embodiment where every two mutually vertically intersected differential pairs are commonly twisted along a longitudinal direction thereof. Under this situation, by selecting properly phase difference between the two adjacent sets so that the mutually induced crosstalk therebetween may be eliminated to a minimum amount similar to what is disclosed in the aforementioned copending application Ser. No. 09/535,426.

The features and advantages of the invention are as follows.

(1) The arrangement can be applied to the printed circuit board, the cable and the connector or other circuits involving the differential pair of conductors.

(2) The arrangement is simple and easy for implementing/manufacturing. No complex twist pair configuration is required in the cable/wire application.

(3) There is no crosstalk at the near end or the far end no matter how long the victim pair is.

(4) The victim conductor(s) can be either single-ended or the differential pair(s) while the aggressor conductor(s) should be a pair.

(5) Since the crosstalk is eliminated right away at any moment and/or section along the longitudinal direction of the conductors, the skew in the differential pair does not cause higher far-end crosstalk.

(6) The diamond/cross-like arrangement of the two differential pairs occupies less real estate in comparison with the traditional plane type arrangement.

(7) More important, as long as the victim pair moves along the center vertical line of the aggressor pair, the crosstalk to each of said victim pair maintains constantly zero. Therefore, the internal distance between such pair of victim conductors can be freely, along such a center vertical line, adjusted to achieve the required/desired impedance without sacrificing the zero crosstalk benefit.

While the present invention has been described with reference to specific embodiments, the described is illustrative of the invention and is not to be construed as limiting the invention. Various modifications to the present invention can be made to the preferred embodiments by those skilled in the art without departing from the true spirit and scope of the invention as defined by the appended claims. Understandably, as long as any differential pair placement (either symmetric or asymmetric) can achieve the zero net crosstalk at each section of the victim(s), there is literally/substantially no near-end or far-end crosstalk for entire victim(s) of either single-ended or differential pair no matter how long the victim(s) is. As mentioned before, if the aggressor pair have internal different size/configuration, the victim conductor should be placed closer to one of this pair for obtaining the zero crosstalk effect induced by both two conductors of that aggressor differential pair. Understandably, if the size/configuration of the aggressor pair define a asymmetric contour, the path along which the victim(s) may be disposed for zero crosstalk, may not be linear. Additionally for example, by using two intersecting differential pairs as a basic set, other adding/reducing alterations, derivations or deformations which may perform either whole or partial zero crosstalk function, are intended to be within the scope of the appended claims.

Therefore, persons of ordinary skill in this field are to understand that all such equivalent structures are to be included within the scope of the following claims.

I claim:

1. A differential pair arrangement comprising:

a first untwisted differential pair of conductors; and a second untwisted differential pair of conductors; wherein said first differential pair and said second differential pair are mutually vertically intersected with each other, so that crosstalk between said first and second differential pairs is substantially zero at any moment and any section; wherein each of said first and second differential pairs which plays as a victim pair, is adapted to move along a center vertical line of the other of said first and second differential pairs to adjust its own impedance while still keeping zero crosstalk benefit.

* * * * *